United States Patent [19]

Dormand

[11] Patent Number: 5,075,833

[45] Date of Patent: Dec. 24, 1991

[54] VANDAL RESISTANT BOLLARD LIGHTS

[76] Inventor: Peter O. Dormand, 147 Rae Crescent, Kotara South, N.S.W. 2288, Australia

[21] Appl. No.: 588,986

[22] Filed: Sep. 26, 1990

Related U.S. Application Data

[63] Continuation-in-part of Ser. No. 404,950, Sep. 5, 1989, Pat. No. 4,999,749.

[51] Int. Cl.[5] ..... F21V 21/00

[52] U.S. Cl. ..... 362/376; 362/431

[58] Field of Search ..... 362/431, 376, 362, 153.1, 362/153, 369, 367

[56] References Cited

U.S. PATENT DOCUMENTS

| | | | |
|---|---|---|---|
| 3,410,995 | 11/1968 | Gray | 362/431 |
| 3,671,738 | 6/1972 | Beachley | 362/431 |
| 3,679,891 | 7/1972 | Quack | 362/431 |
| 3,798,438 | 3/1974 | Menichetti | 362/431 |
| 4,231,080 | 10/1980 | Compton | 362/348 |
| 4,392,192 | 7/1983 | Steadman | 362/431 |
| 4,438,484 | 3/1984 | Winden | 362/431 |
| 4,453,202 | 6/1984 | Morris et al. | 362/360 |
| 4,794,502 | 12/1988 | Guggemos | 362/363 |

FOREIGN PATENT DOCUMENTS

| | | | |
|---|---|---|---|
| 1801666 | 6/1970 | Fed. Rep. of Germany | 362/431 |
| 331772 | 7/1930 | United Kingdom | 362/431 |
| 1402537 | 8/1975 | United Kingdom | 362/431 |

*Primary Examiner*—Ira S. Lazarus
*Assistant Examiner*—Richard R. Cole
*Attorney, Agent, or Firm*—Christopher John Rudy

[57] ABSTRACT

A bollard light has a vertical steel tube of predetermined heavy gauge, a plurality of apertures in the upper end of the tube to allow light emanating from within the tube to be transmitted therefrom, one or more protecting louvres and a cap member, also of steel of predetermined heavy gauge, located about the upper end of the tube to at least substantially hide from normal view a light diffuser, located within the tube and adapted to diffuse light emanating from within the tube through the apertures. The louvre(s) are welded to the tube. The cap member is removably securable to the tube. Light emitting means is located within the upper end of the tube.

15 Claims, 3 Drawing Sheets

VANDAL RESISTANT BOLLARD LIGHTS

RELATED ART

This application is a continuation-in-part of application Ser. No. 07/404,950 filed Sept. 5, 1989, incorproated herein by reference. Said application issued Mar. 12, 1991 as U.S. Pat. No. 4,999,749.

BACKGROUND OF THE INVENTION

This invention relates to bollard lights and provides a modification of or improvement over the bollard light depicted and described in the above specified application.

Bollard lights are used by local authorities to light paths, e.g., in parks or along the waterfront at night. Such objects are prone to vandalism. A vandal will attack an object such as a bollard light, either by kicking the same, by attacking the same with a baseball bat, iron pipe or the like, or by rocking the same to take advantage of any movement available from its normally fixed location, until the bollard itself breaks or is broken from its foundation.

OBJECT OF THE INVENTION

It is an object of this invention to provide a vandal resistant bollard light.

SUMMARY OF THE INVENTION

This invention in one broad form provides a bollard light consisting essentially of a vertical tube of steel of predetermined heavy gauge, a plurality of apertures in the upper end of said tube to allow light emanating from within said tube to be transmitted therefrom, one or more protecting louvres and a cap member also of steel of predetermined heavy gauge located about the upper end of said tube to at least substantially hide from normal view a light diffuser located within said tube adapted to diffuse light emanating from within said tube through said openings, said louvre(s) being welded to said tube and said cap being removably securable thereto, and light emitting means located within the upper end of said tube. The bollard light of this invention may comprise these recited components.

DETAILED DESCRIPTION OF THE INVENTION

It is preferred that the tube be of diameter of 150 mm and that the tube, louvres and cap be of spun heavy gauge mild steel, for example, 12 gauge 5 mm mild steel.

The cap is preferably affixed to the top of the tube by countersunk screws which require a special tool for their removal.

It is further preferred that the base of said vertical tube be provided with a base plate, welded to said tube, to enable it to be securely bolted down to a concrete plynth when the device is located for permanent use.

The preferred cap and louvres are dome shaped with the annuli of the louvres being typically about 50 mm in horizontal section at their broadest portions. A horizontal gap of about 10 mm is provided between the cap skirt and the vertically highest point of the uppermost louvre through this gap. Access may be had by special tool to the countersunk screws by which the cap is secured to the tube.

By way of example only, one preferred embodiment of a light bollard according to this invention will now be described with reference to the accompanying drawings wherein.

Figure 1:
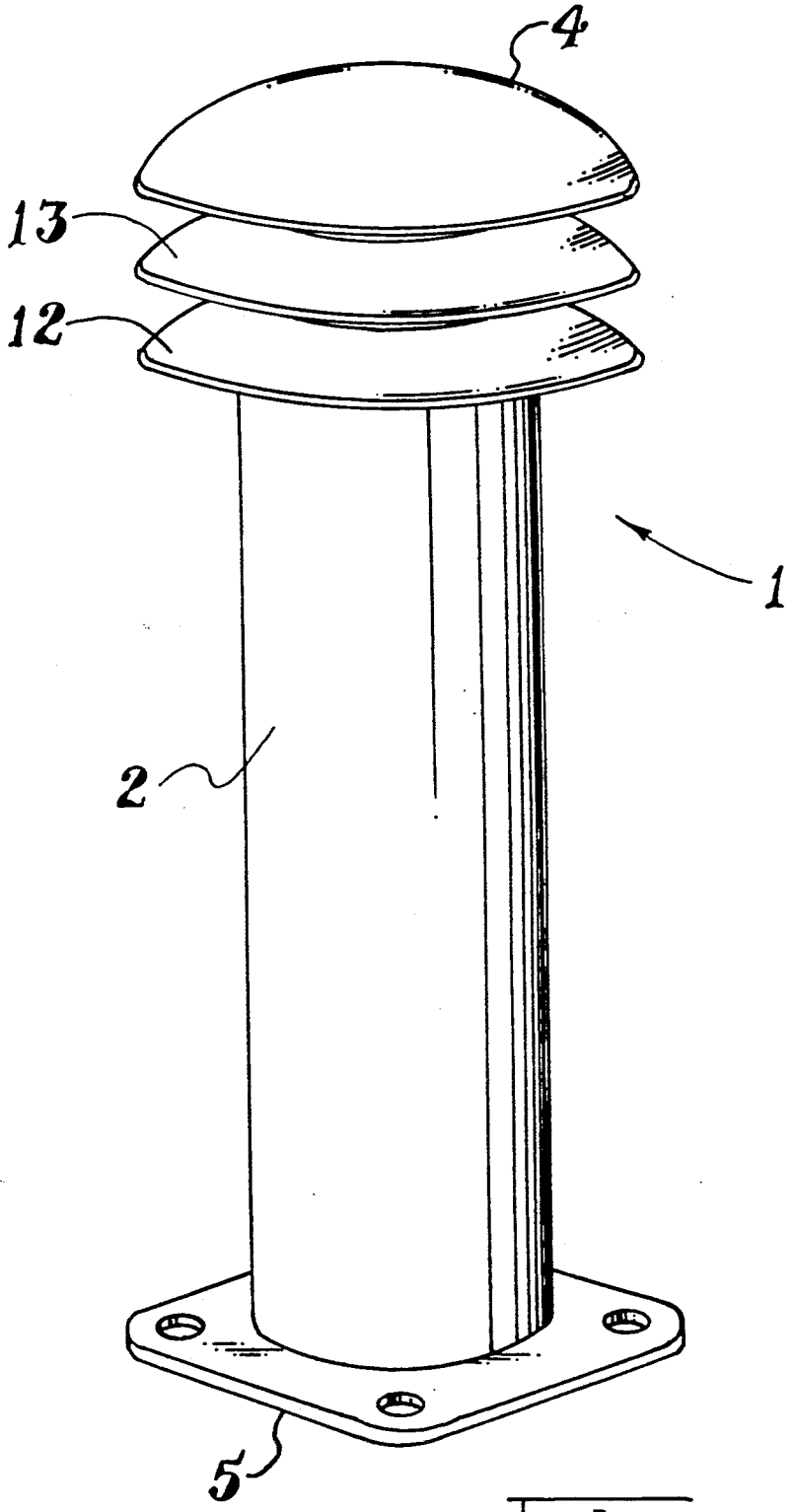
FIG. 1 depicts, in section, an assembled bollard light.

In the drawings, bollard light, shown generally at 1, has cylindrical tube 2 of 150 mm diameter fabricated from heavy gauge mild steel. From the same material are fabricated dome shaped annular louvres 12, 13 and dome shaped cap member 4. Louvres 12 and 13 are welded to tube 2 as is horizontal skirt 5. Cap 4 is affixed to tube 2 by 4 mm countersunk hexagonal screws 6 located through apertures (not shown) in the periphery of cylindrical cap portion 7 which extends axially from the inner roof portion of cap 4.

A horizontal gap 9 of 10 mm is provided between the lower periphery of cap 4 and louvre 13 and a like gap is provided between louvre 13 and louvre 12. Access by special tool is available through gap 9 to locate and remove screws 6.

Apertures or portholes 10 are provided in the upper end of tube 2 to allow passage of light therethrough. These portholes are protected by louvres 12, 13 and cap 4 and are not within normal view. Located within the upper portion of tube 2 is diffuser 11 which is located against the inner cylindrical portion of tube 2 to extend over portholes 10 to at least substantially weatherproof the interior of tube 2.

Stainless steel stud 14 is secured through the wall of tube 2. The gear tray assembly 16 is located by means of a keyhole shaped aperture that allows the gear tray to hang on stud 14. Gear tray assembly 16 comprises vertical folded aluminium tray fitted with lamp socket 18, lamp socket skirt 19, reflector 19A, and control gear power terminals 20. Power supply is provided from mains services by incoming wiring 21. Current is transmitted from terminal 20 through capacitor 31 and choke assembly 32 to lamp socket 18 via conductors (not shown) mounted on assembly 16. The incoming earthing (grounding) cable associated in the group of cables 21 is connected to gear tray terminal block 20. The main body 2 is earthed (grounded) through earthing strap 22 and connected to stud 14.

Figures 2, 3, 4:
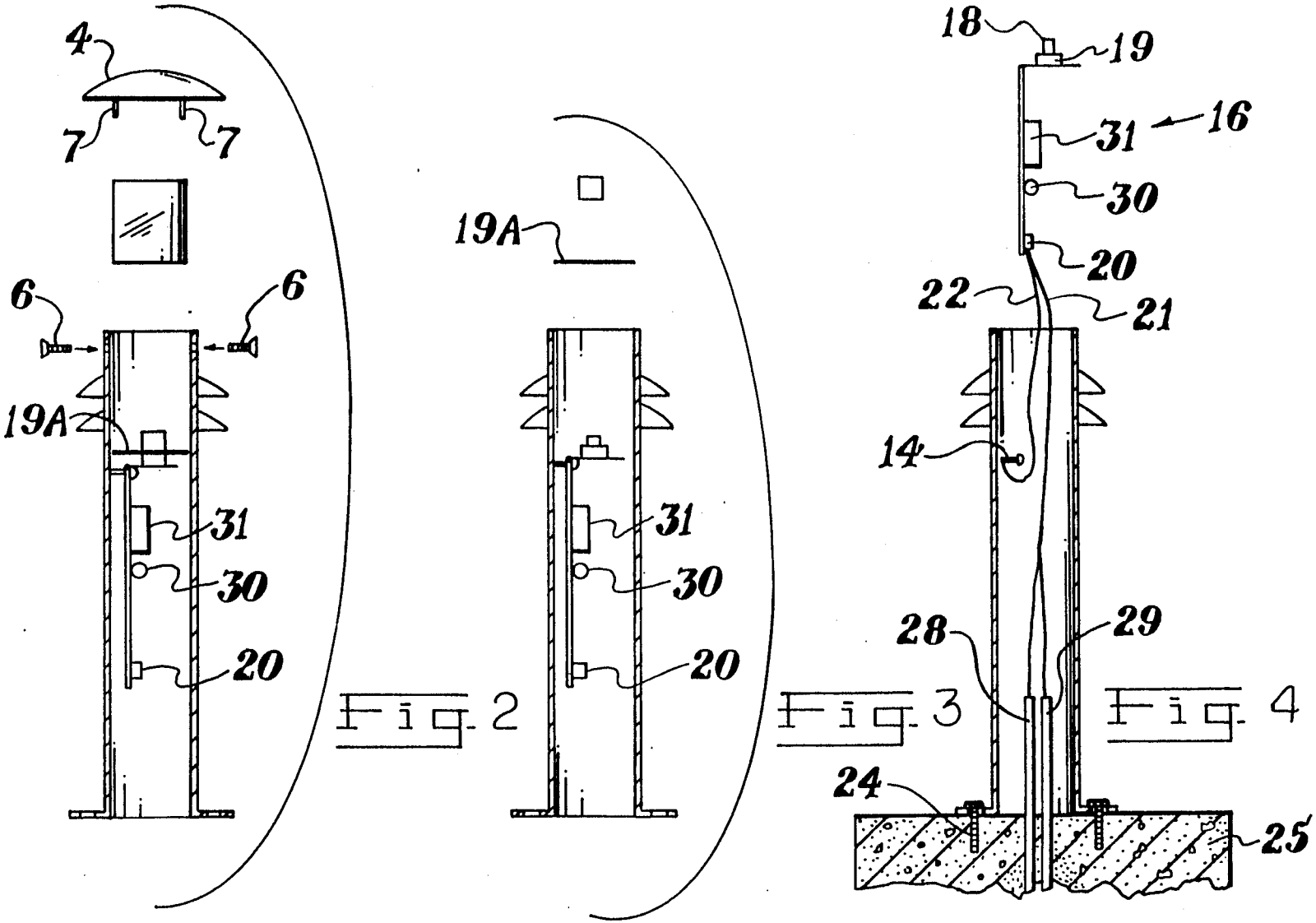
FIG. 2 is an exploded view, in section, of the bollard light of FIG. 1.
FIG. 3 is an exploded view, in section, of a partially disassembled bollard light according to FIG. 1.
FIG. 4 is an exploded view, in section, of a bollard light according to FIG. 1 is a more advanced disassembly situation than that shown in FIG. 3.
Figure 5:
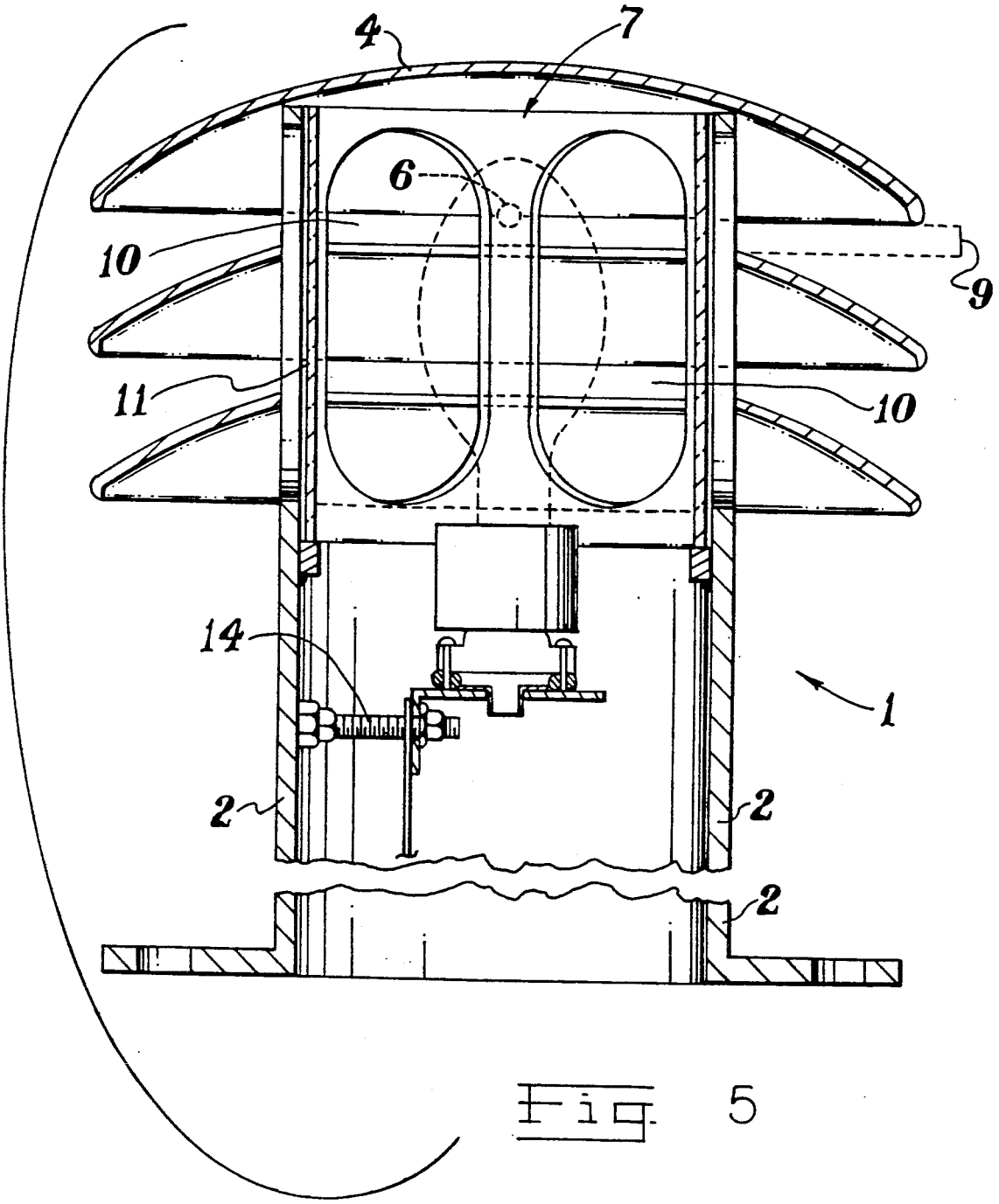
FIG. 5 is a cross-sectional view of the bollard light of FIG. 1.

As shown in FIG. 4, bollard 1 is located by securing anchors 24 to concrete plynth 25, wiring 21 being introduced to the interior of bollard 1 through conduits 28, 29 which extend through plynth 25.

The bollard light of this invention is a product of simple, yet very strong construction able to withstand the normal vandalizing to which objects in public parks are normally subjected.

The present invention is thus provided. Various adaptations can be effected by those skilled in the art within its spirit, the scope of which is particularly pointed out by the following subject matter in conclusion whereof.

What I claim is:

1. A bollard light consisting essentially of a vertical tube of steel of predetermined heavy gauge, a plurality of apertures in an upper end of said tube to allow light emanating from light emitting means located within the upper end of said tube to be transmitted therefrom, at least one protecting louvre(s), and a cap member with a skirt, also of steel of predetermined heavy gauge, located about the upper end of said tube to at least substantially hide from normal view a light diffuser located within said tube, adapted to diffuse light emanating from within said tube and through said apertures, said louvre(s) being welded to said tube, said cap being removably securable thereto, an annular skirt of heavy gauge mild steel being welded to a lower portion of said tube, and said light emitting means being mounted on an assembly, which assembly is mounted on a securing means fixed to an inner wall directly adjacent said upper end of said tube.

2. A bollard light as defined in claim 1 wherein said tube, louvre(s), cap and skirt are fabricated of spun 12 gauge 5 mm mild steel.

3. A bollard light as defined in claim 1 wherein said tube is of a diameter of about 150 mm.

4. A bollard light as defined in claim 2 wherein said tube is of a diameter of about 150 mm.

5. A bollard light as defined in claim 1 wherein said cap is securable to said tube by countersunk screws requiring a special tool for location and removal.

6. A bollard light as defined in claim 1 wherein said cap is dome shaped and said louvre(s) is(are) (a) dome annulus (i), a horizontal gap of about 10 mm being in effect between the skirt of said cap and the vertically highest portion of said louvre located immediately beneath said cap.

7. A bollard light as defined in claim 1 wherein said light emitting means has a globe or lamp mounted on a said assembly having a socket for said globe or lamp, a horizontal annular reflective disc disposed on a support arm around a base of said socket, and a vertical arm connected to said support arm, said securing means being a stud, said vertical arm being supported by said securing stud, and said vertical arm being provided with connection points for power supply connecting means.

8. A bollard light comprising a vertical tube of steel of predetermined heavy gauge, a plurality of apertures in an upper end of said tube allowing light emanating from within said tube to be transmitted therefrom, at least one protecting louvre, and a cap member with a skirt, also of steel of predetermined heavy gauge, located about the upper end of said tube to at least substantially hide from normal view a light diffuser located within said tube, adapted to diffuse light emanating from within said tube through said apertures, said louvre(s) being welded to said tube, said cap being removably securable thereto, and light emitting means being located within the upper end of said tube, wherein said light emitting means has a globe or lamp mounted on a gear tray assembly having a socket, with a base, for said globe or lamp, a horizontal annular reflective disc disposed on a support arm around the base of said socket, and a vertical arm connected to said support arm, said vertical arm being supported by a securing stud fixed to an inner wall directly adjacent said upper end of said tube, and said vertical arm being provided with connection points for power supply connecting means.

9. A bollard light as defined in claim 8 wherein said tube, louvres and cap are fabricated of spun 12 gauge 5 mm mild steel.

10. A bollard light as defined in claim 8 wherein said tube is of diameter of about 150 mm.

11. A bollard light as defined in claim 9 wherein said tube is of diameter of about 150 mm.

12. A bollard light as defined in claim 8 wherein said cap is securable to said tube by countersunk screws requiring a special tool for location and removal.

13. A bollard light as defined in claim 8 wherein said cap is dome shaped and said louvre(s) is(are) dome shaped annuli, a horizontal gap of about 10 mm being in effect between the skirt of said cap and the vertically highest portion of said louvre located immediately beneath said cap.

14. A bollard light as defined in claim 8 further comprising an annular skirt welded in the lower portion of said tube, said skirt being of heavy gauge mild steel.

15. A bollard light as defined in claim 14 wherein said skirt is fabricated of 12 gauge 5 mm mild steel.

* * * * *